US007575369B2

(12) United States Patent
Bitterli et al.

(10) Patent No.: US 7,575,369 B2
(45) Date of Patent: Aug. 18, 2009

(54) ASSEMBLY ELEMENT INCLUDING TWO SERIES OF ELASTIC STRUCTURES AND TIMEPIECE FITTED WITH THE SAME

(75) Inventors: Roland Bitterli, Neuchâtel (CH); Wilfried Noell, Neuchâtel (CH); Fabien Blondeau, Le Landeron (CH); Lionel Paratte, Neuchâtel (CH); Toralf Scharf, Neuchâtel (CH); Pierre-André Meister, Bienne (CH); André Zanetta, Neuchâtel (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 11/937,789

(22) Filed: Nov. 9, 2007

(65) Prior Publication Data

US 2008/0112276 A1 May 15, 2008

(30) Foreign Application Priority Data

Nov. 9, 2006 (EP) ..... 06123781

(51) Int. Cl.
*G04B 29/00* (2006.01)
*G04B 31/00* (2006.01)

(52) U.S. Cl. ..... 368/324; 368/322; 368/238; 116/328

(58) Field of Classification Search ..... 368/44, 368/238, 228, 323, 80, 322, 324–326; 116/332, 116/328; 384/37
See application file for complete search history.

(56) References Cited

U.S. PATENT DOCUMENTS 0,185,272 A 12/1876 Weston
0,267,824 A 11/1882 Bell
1,645,510 A 10/1927 Wood
3,306,027 A 2/1967 Schneider
3,922,041 A 11/1975 Quaile et al.
4,127,928 A 12/1978 Green
4,358,166 A 11/1982 Antoine (Continued)

FOREIGN PATENT DOCUMENTS

EP 1655642 A2 5/2006

(Continued)

OTHER PUBLICATIONS

European Search Report issued in corresponding application No. EP 06 12 3781, completed Aug. 7, 2007.

(Continued)

*Primary Examiner*—Vit W Miska
*Assistant Examiner*—Sean Kayes
(74) *Attorney, Agent, or Firm*—Griffin & Szipl, P.C.

(57) ABSTRACT

Assembly element (18) made in a plate of brittle material, including an aperture (32) provided for the axial insertion of an arbour (26). The inner wall (33) of the aperture (32) includes elastic structures (34), which are etched into the plate and which each include at least one support surface (36) for gripping the arbour (26) radially in order to secure the assembly element (18) relative to the arbour (26). The assembly element (18) includes a first series (S1) of elastic structures (34) etched in a top layer (39) of the plate and a second series (S2) of elastic structures (34) etched in a bottom layer (41) of the plate.

A timepiece may be fitted with this assembly element.

14 Claims, 6 Drawing Sheets

U.S. PATENT DOCUMENTS

| | | | | |
|---|---|---|---|---|
| 6,453,772 | B1 | 9/2002 | Moskob | |
| 2003/0007706 | A1 * | 1/2003 | Suh et al. | 384/125 |
| 2006/0055097 | A1 | 3/2006 | Conus et al. | |

FOREIGN PATENT DOCUMENTS

| | | | |
|---|---|---|---|
| EP | 1659460 | A1 | 5/2006 |
| EP | 1708045 | A2 | 10/2006 |
| FR | 2006825 | | 1/1970 |

OTHER PUBLICATIONS

Office Action issued in related co-pending U.S. Appl. No. 11/937,696, dated May 15, 2008.

Notice of Allowance issued in related co-pending U.S. Appl. No. 11/937,738, dated Jun. 13, 2008.

Austrian search report issued in a related Singapore application No. 200717510-2, dated Sep. 10, 2008.

* cited by examiner

ASSEMBLY ELEMENT INCLUDING TWO SERIES OF ELASTIC STRUCTURES AND TIMEPIECE FITTED WITH THE SAME

This application claims priority from European Patent Application No. 06123781.4 filed 9 Nov. 2006, the entire disclosure of which is incorporated herein by reference.

BACKGROUND OF THE INVENTION

The invention concerns an assembly element and a timepiece comprising the same.

The invention concerns more specifically an assembly element made in a plate of brittle material such as silicon, particularly for a timepiece, including an aperture provided for the axial insertion of an arbor, the inner wall of the aperture including elastic structures which are etched in the plate and which each comprise at least one support surface for gripping or squeezing the arbor radially in order to secure the assembly element relative to the arbor, wherein each elastic structure includes a first rectilinear elastic strip which extends along a tangential direction relative to the arbor, the support surface being arranged on the inner face of the first elastic strip.

Generally, in timepieces, the assembly elements such as the timepiece hands and the toothed wheels are secured by being driven into their rotating arbor, i.e. a hollow cylinder is forced onto a pin whose diameter is slightly greater than the inner diameter of the cylinder. The elastic and plastic properties of the material employed, generally a metal, are used for driving in said elements. For components made of a brittle material such as silicon, which does not have a usable plastic range, it is not possible to drive a hollow cylinder onto a conventional rotating arbor like those used in mechanical watchmaking, with a diameter tolerance of the order of +/−5 microns.

Moreover, the solution for securing an assembly element such as a hand must provide sufficient force to hold the element in place in the event of shocks. The force necessary for a conventional timepiece hand is, for example, of the order of one Newton.

In order to overcome these problems, it has already been proposed to make, in an assembly element such as a silicon balance spring collet, flexible strip shaped elastic structures arranged on the periphery of the aperture, so as to secure the collet onto an arbor by a driving in type arrangement, using the elastic deformation of the strips to grip the arbor and retain the collet on the arbor. An example of this type of securing method is disclosed in particular in EP Patent No. 1 655 642.

SUMMARY OF THE INVENTION

It is an object of the invention to provide improvements to this solution, particularly to allow the use of this assembly element as a rotating element in a timepiece mechanism, in particular as a timepiece hand.

Thus, the invention proposes an assembly element of the type described previously, characterized in that the assembly element includes a first series of elastic structures etched in an upper layer of the plate and a second series of elastic structures etched in a bottom layer of the plate.

The assembly element according to the invention improves the gripping force against the arbor, to allow better distribution of the stress linked to the elastic deformation in the material forming the assembly element, and to allow better control of the gripping force obtained on the arbor while remaining far from the breaking domain of the material.

Moreover, making elastic structures in two layers of the plate maximizes the number of elastic structures relative to the volume size.

According to another feature of the invention, the elastic structures of the first series are of different types from the elastic structures of the second series.

The combination of elastic structures of different types between the top layer and the bottom layer allows the technical advantages of the two types of structures to be combined, for example in order to optimize resistance to linear accelerations, along the axis of rotation, and to angular accelerations, relative to the axis of rotation.

According to other features of the invention:

- the two series of elastic structures are shifted angularly in relation to each other, such that at least one part of the support surfaces thereof is shifted angularly in relation to each other;
- the plate is of the silicon on insulator type with a top layer and a bottom layer of silicon separated by an intermediate layer of silicon oxide;
- the plate is of the asymmetrical silicon on insulator type with a thin top layer and a thick bottom layer, and the first series of elastic structures is made in the top layer and the second series of elastic structures is made in the bottom layer;
- the assembly element is formed by a rotating element that is fixedly mounted in rotation to the arbor, the main body of the rotating element extends into the top layer, and the second series of elastic structures is made in an axial extension of the main body located in the bottom layer;
- a timepiece hand forms the assembly element.
- at least one series of elastic structures is of the type wherein each elastic structure is formed by a radial stack of several parallel elastic strips, each elastic strip being separated radially from the adjacent elastic strip by a rectilinear separator hole in two parts, the two parts of the separator hole being separated by a bridge of material which connects the two adjacent elastic strips and which is substantially radially aligned with the support surface, the last elastic strip of the stack, which is located on the opposite side to the first strip, being radially separated from the rest of the plate by a hole in a single piece, called the clearance hole, which defines a radial clearance space for the elastic structure;
- at least one series of elastic structures is of the type wherein each elastic structure is formed by a fork which is connected to the inner wall of the aperture by a bridge of material and which includes two branches extending, on either side of the bridge of material, generally towards the arbor, each branch including a support surface in proximity to the free end thereof.

The invention also proposes a timepiece characterized in that it includes at least one assembly element according to any of the preceding features.

BRIEF DESCRIPTION OF THE DRAWINGS

Other features and advantages of the present invention will appear more clearly upon reading the following detailed description, made with reference to the annexed drawings, given by way of non limiting example, in which.

DESCRIPTION OF THE PREFERRED EMBODIMENTS

Figure 1:
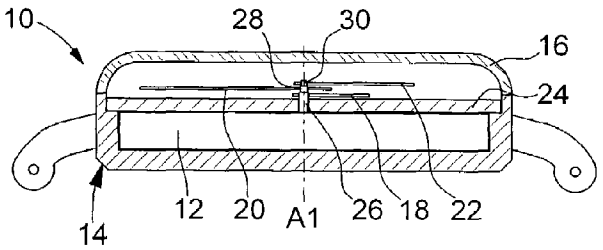
FIG. 1 is an axial cross-section which shows schematically a timepiece fitted with assembly elements formed by timepiece hands made from a plate of brittle material in accordance with the teaching of the invention.

In the following description, identical or similar elements will be designated by the same reference numerals.

FIG. 1 shows schematically a timepiece 10 which is made in accordance with the teaching of the invention.

Timepiece 10 includes a movement 12 mounted inside a case 14 closed by a crystal 16. Movement 12 drives in rotation, about an axis A1, analogue display means formed here by an hour hand 18, a minute hand 20 and a second hand 22, these hands extending above a dial 24. Hands 18, 20, 22 are secured by being elastic gripped to coaxial cylindrical rotating arbors 26, 28, 30, in a driving in type arrangement, as will be seen hereafter.

Preferably, arbors 26, 28, 30 are conventional arbors commonly used in timepiece movements, for example metal or plastic arbors.

In the following description, we will use in a non-limiting manner, an axial orientation along rotational axis A1 of hands 18, 20, 22 and a radial orientation relative to axis A1. Moreover, elements will be termed inner or outer depending upon their radial orientation relative to axis A1.

Hands 18, 20, 22 form assembly elements, each hand 18, 20, 22 being made in a plate of brittle material, preferably a silicon based crystalline material.

Figure 2:
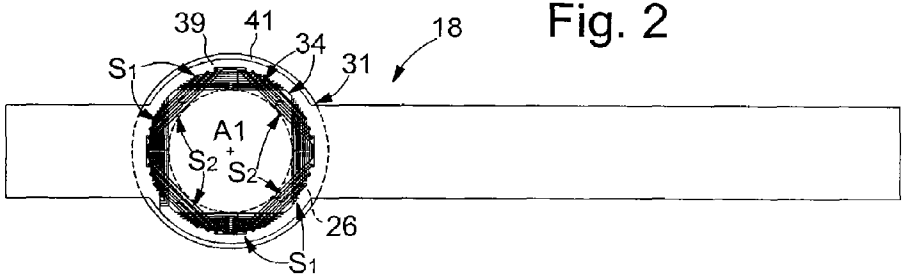
FIGS. 2 to 4 are top views that show schematically respectively the hour hand, the minute hand and the second hand fitted to the timepiece of FIG. 1 and which are provided with superposed elastic strip structures etched in a top layer and in a bottom layer of each hand.
Figure 3:
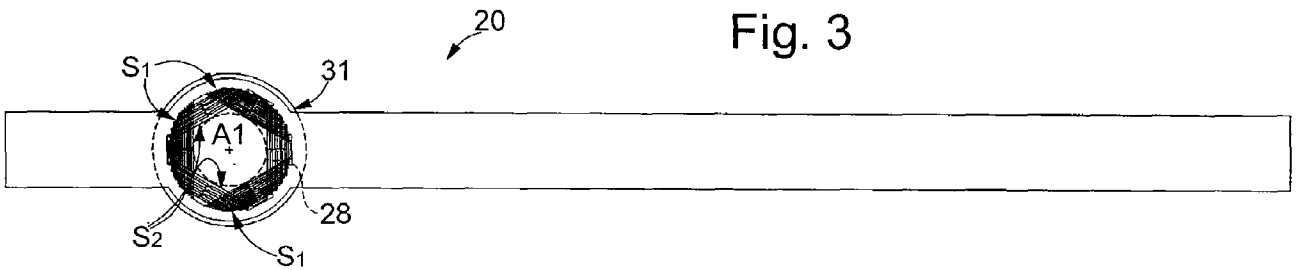
Figure 4:
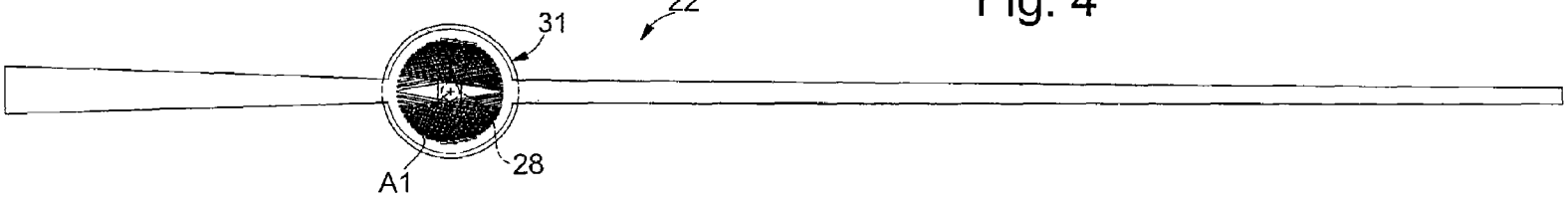

FIGS. 2, 3 and 4 show an advantageous embodiment for each of the three hands, respectively for hour hand 18, minute hand 20 and second hand 22. Each hand 18, 20, 22 includes here a mounting ring 31, which delimits an aperture 32 provided for securing the hand 18, 20, 22 to the associated arbor 26, 28, 30 by axial insertion into aperture 32. The inner wall 33 of aperture 32 includes elastic structures 34, which are etched in the plate forming mounting ring 31 and which each include at least one support surface 36 for radially gripping the associated arbor 26, 28, 30 in order to retain hand 18, 20, 22 axially and radially on arbor 26, 28, 30 and in order to secure the arbor and associated hand to each other in rotation.

Figure 15:
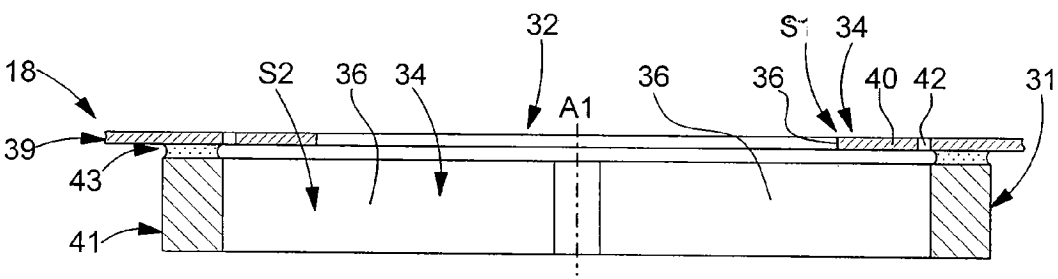
FIG. 15 is an axial cross-section along the plane 15-15 that shows the mounting ring of the hour hand of FIG. 2.

In accordance with the teaching of the invention, each hand 18, 20, 22 includes a first series S1 of elastic structures 34, which are etched in a top layer 39 of the plate and a second series S2 of elastic structures, which are etched in a bottom layer 41 of the plate, as illustrated by the cross-section of FIG. 15.

Advantageously, each hand 18, 20, 22 is made in an asymmetrical plate of SOI (silicon on insulator) type silicon which includes a thin top silicon layer 39 and a thick bottom silicon layer 41 separated by an intermediate silicon oxide layer 43. This type of plate has the particular advantage of facilitating manufacture of distinct structures by two etching steps, for example by chemically etching the side of top layer 39 and by another chemical etch on the side of bottom layer 41, intermediate layer 43 stopping the etch adequately to limit the etch respectively in each of layers 39 and 41. After etching the top and bottom layers 39, 41, another etch is implemented to remove intermediate layer 43 in determined zones in order to release elastic structures 34 to allow the elastic deformation of the latter.

After each hand 18, 20, 22 has been etched, top layer 39 and bottom layer 41 remain connected by portions of intermediate layer 43 which have not been etched. These connecting portions are located here in ring 31, on the periphery of aperture 32.

According to the embodiments shown, bottom silicon layer 41 is preserved exclusively underneath the mounting ring 31 of each hand 18, 20, 22 and it forms a bottom axial extension, relative to the rest of the body of hand 18, 20, 22, which is formed in thin top layer 39, as can be seen in FIG. 15.

A first advantageous embodiment of elastic structures 34 according to the invention will now be described by examining hour hand 18, as shown in FIG. 2 and as shown in an enlarged manner in FIG. 5 and in cross-section in FIG. 15. It will be noted that elastic structures 34 are shown here at rest, i.e. prior to being deformed by the insertion of the associated arbor 26, 28, 30.

According to the first embodiment, the elastic structures 34 of the first series S1 and second series S2 are of similar types, here of the type comprising a radial stack of rectilinear and parallel strips $L_n$ of substantially constant radial thickness. Elastic strips $L_n$ each extend along a tangential direction relative to the associated arbor 26. The support surface 36 of each elastic structure 34 is arranged on the inner face 38 of the first elastic strip $L_1$ of the stack, on the side of arbor 26. In each elastic structure 34, each elastic strip $L_n$ is separated radially from the adjacent elastic strip $L_{n+1}$, $L_{n-1}$ by a rectilinear separator hole $I_n$ in two parts $I_{na}$, $I_{nb}$, the two parts $I_{na}$, $I_{nb}$ of separator hole $I_n$ being separated by a bridge of material $P_n$ which connects the two adjacent elastic strips $L_n$ and which is substantially aligned radially with support surface 36. The continuous series of bridges of material $P_n$ between elastic strips $L_n$ thus forms a radial connecting beam 40.

Advantageously, the end of each separator hole $I_n$ has a rounded profile, for example in a semi-circle, so as to prevent an accumulation of mechanical stresses at the ends which could cause the start of cracks when elastic strips $L_n$ bend.

In the example shown, the stack forming elastic structure 34 includes three elastic strips $L_1$, $L_2$, $L_3$ and two separator holes $I_1$, $I_2$. The radial thicknesses of separator holes $I_{1n}$ are substantially constant and identical here.

According to another feature of the invention, the last elastic strip $L_3$ of the stack, which is located on the opposite side to the first strip $L_1$, is separated radially from the rest of the plate forming hand 18 by a hole 42 in a single part, called the clearance hole 42. The minimum radial thickness of the clearance hole 42 determines the maximum radial clearance of elastic structure 34. Preferably, the radial thickness of clearance hole 42 is substantially constant and greater than the radial thickness of separator holes $I_n$.

Preferably, the number of elastic strips $L_n$ forming each elastic structure 34 of thick bottom layer 41 is smaller than the number of elastic strips $L_n$ forming each elastic structure 34 of thin top layer 39.

When arbor 26 is inserted into aperture 32, the effort exerted on support surface 36 causes an elastic deformation of all of the elastic strips $L_n$ of each elastic structure 34, such that the central part of these strips $L_n$ moves outwards radially, reducing the radial thickness of clearance hole 42 to the right of beam 40. This elastic deformation generates a radial gripping force on arbor 26, similar to a driving in arrangement.

It will be noted that connecting beam 40 connects all of the elastic strips Ln to each other, so that they can all be deformed simultaneously when a radial effort is applied to support surface 36, and so as to distribute the mechanical stresses at several places to minimize the risk of breakage.

Preferably, in each elastic structure 34, the length of elastic strips $L_n$ gradually decreases from the first elastic strip $L_1$ to the last elastic strip $L_3$ of the stack, which overall follows the curvature of the external cylindrical wall 44 of mounting ring 31.

Figure 5:
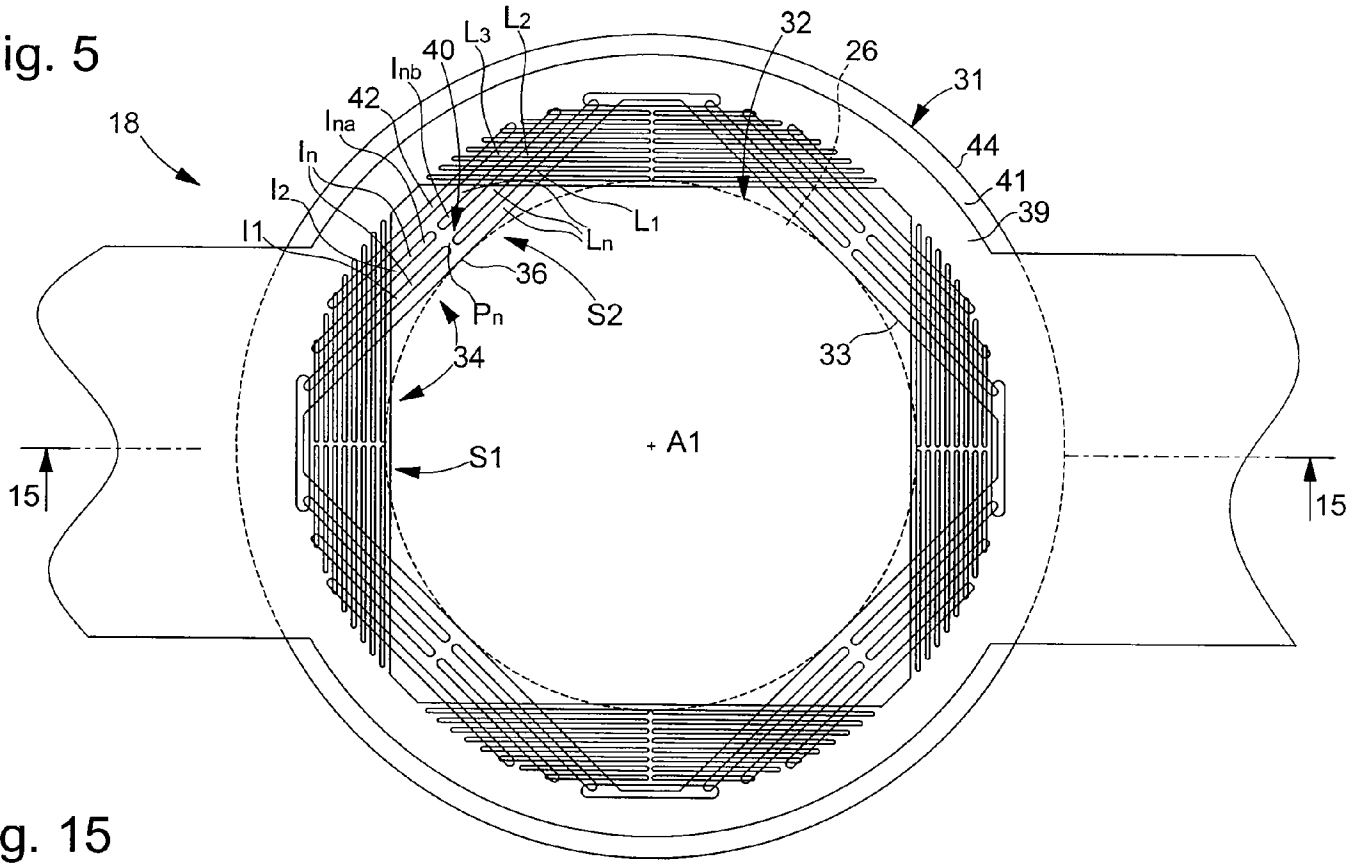
FIG. 5 and FIG. 6 are partial enlarged views of the mounting ring of the hour hand of FIG. 2 and the second hand of FIG. 4.

According to the embodiment shown in FIG. 5, the radial thickness of each separator hole In is substantially constant over the entire length thereof and the radial thickness of all of the separator holes In is substantially equal. In order to obtain maximum gripping force on arbor 26, in a given volume of material of mounting ring 31, the radial thickness of each separator hole In is minimized.

Advantageously, for each hand 18, 20, 22, the number of elastic structures 34 arranged around aperture 32, in each series S1, S2 of elastic structures 34 is selected as a function of the diameter of the associated arbor 26, 28, 30 and as a function of the radial space available between inner wall 33 of aperture 32 and the outer wall 44 of mounting ring 31 of hand 18, 20, 22. Thus, the larger the diameter of arbor 26, 28, 30, and the smaller the aforementioned radial space, the larger the number of elastic structures 34.

Thus, in this embodiment, since the diameter of arbor 26 associated with hour hand 18 is much greater than the diameter of the arbor 30 associated with second hand 22, and since the external diameter of mounting ring 31 does not change proportionally, we have selected a number of elastic structures 34 equal to four in each of series S1, S2 for hour hand 18, whereas the number of elastic structures 34 in each series S1, S2 is equal to two for second hand 22. In an intermediate fashion, the number of elastic structures 34 in each series S1, S2 for minute hand 20 is equal here to three.

It will be noted that, for hour hand 18 and minute hand 20, elastic structures 34 are distributed regularly around axis A1, such that the shape of the inner contour of aperture 32 is respectively overall square and triangular.

It will be noted that making the securing system with at least three elastic structures 34 facilitates the centering of mounting ring 31 relative to the associated arbor 26, 28, 30.

Advantageously, the number of elastic structures 34 is the same in both series S1, S2, but the elastic structures 34 of the first series S1 are shifted angularly relative to the elastic structures 34 of the second series S2. Thus, if we consider the hour hand 18 in FIG. 5, the elastic structures 34 of the two series S1, S2 are shifted by Π/4. The angular shift allows the elastic gripping force to be properly distributed over the periphery of arbor 26 while angularly shifting support surfaces 36 of the elastic structures 34 of the first series S1 relative to the support surfaces 36 of elastic structures 34 of the second series S2. This angular shift also has advantages as regards manufacturing, during the etch steps, since it minimizes the surface of intermediate layer 43 whose two transverse faces are released, after RIE plasma etching of the two sides of the plate (SOI).

According to the embodiments shown, the elastic structures 34 of each series S1, S2 are angularly shifted by Π/3 in minute hand 20 and by Π/2 in second hand 22.

According to another advantageous feature, the number of elastic strips $L_n$ is different between the elastic structures 34 of the first series S1 and the second series S2, which allows the value of the elastic gripping force on arbor 26 to be more finely adjusted. This also allows the gripping force value to be adjusted as a function of the axial thickness of elastic strips $L_n$, since the elastic strips $L_n$ of bottom layer 41 are thicker axially than those of top layer 39, because of the difference in axial thickness between the two layers 39, 41.

Figure 6:
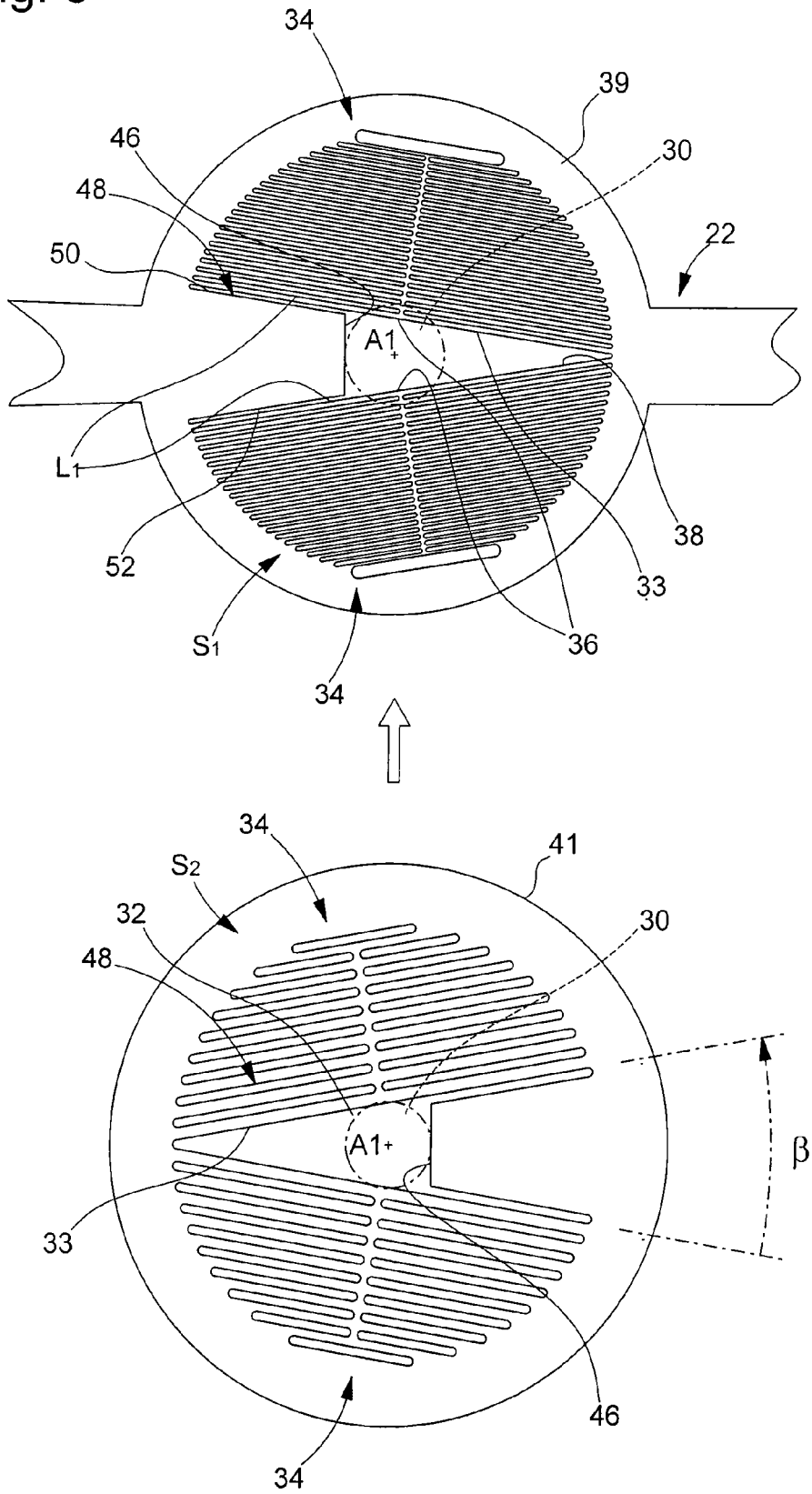
Figure 7:
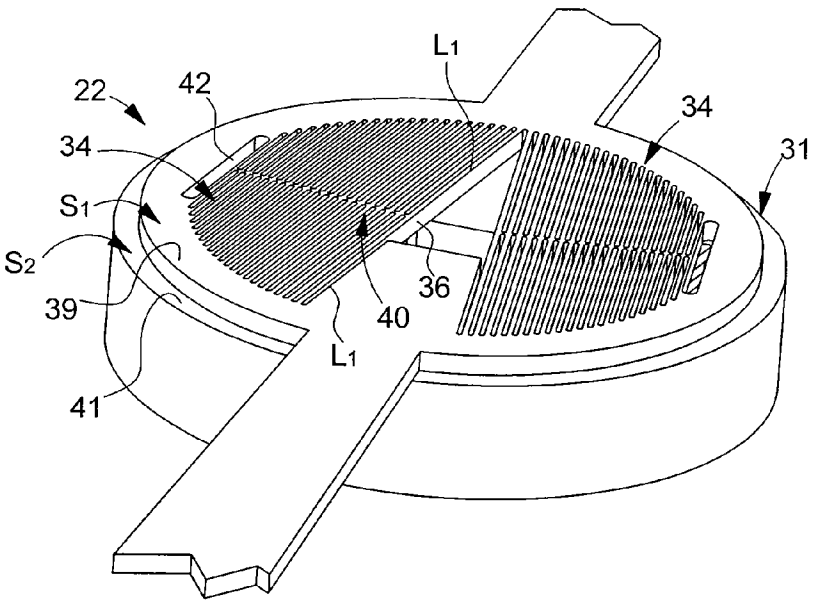
FIG. 7 is a partial perspective view which shows the mounting ring of the second hand of FIG. 4.

We will now describe, with particular reference to FIGS. 6 and 7, the specific structure of second hand 22, of which each series S1, S2 has only two elastic structures 34 and one fixed support surface 46. According to this embodiment, the first elastic strips $L_1$ of the two elastic structures 34 of each series S1, S2 define between them an acute angle β and they are substantially joined at one of the fixed ends thereof. Angle β has, for example, a value of thirty degrees.

In order to simplify the diagram and facilitate the description, the two layers 39, 41 and the series S1, S2 of associated elastic structures 34 of hand 22 are shown side by side in FIG. 6.

The structure of top layer 39 and the associated elastic structures (S1), will now be described, taking account of the fact that the structure of bottom layer 41 is similar but shifted by half a revolution.

The fixed support surface 46 extends along a tangential direction, relative to the associated arbor 30, and it forms the base of an isosceles triangle whose two other sides are formed by the inner face 38 of the first elastic strips $L_1$ of the two elastic structures 34. The fixed support surface 46 is arranged here at the free end of an overall trapeze shaped cut out portion 48, projecting inside aperture 32. Cut out portion 48 is etched into the plate forming hand 22 and it includes here two lateral walls 50, 52, which each extend parallel to the first strip $L_1$ of the opposite elastic structure 34.

The arbor 30 associated with second hand 22 is for abutting against the fixed support surface 46 and against the support surfaces 36 of elastic structures 34.

It will be noted that the contour of the inner wall 33 of aperture 32 has the overall shape of an isosceles triangle.

According to an advantageous embodiment shown in FIG. 6, in each elastic structure 34, the radial thickness of each elastic strip Ln is substantially constant over the entire length thereof and the radial thickness of the elastic strips Ln decreases gradually from the first elastic strip L1 to the last elastic strip L9 of the stack, each elastic structure 34 of the first series S1 including here twenty-one elastic strips Ln of decreasing length, from the interior outwards and each elastic structure 34 of the second series S2 including here nine elastic strips Ln of decreasing length from the interior outwards. Thus, the radial thickness of the elastic strips L1 is adapted to the length thereof, which allows substantially homogenous flexibility to be obtained for all of elastic strips Ln despite their different lengths. The invention thus homogenizes the mechanical stresses in the entire volume of material used for securing, i.e. here in the entire mounting ring 31.

Of course this difference in thickness between the elastic strips $L_n$ could be applied to the other embodiments of hands 18, 20, 22.

It will be noted that the number of elastic strips $L_n$ forming each stack can be adapted depending upon various parameters, particularly as a function of the radial space available, as a function of the desired gripping force on the associated arbor, as a function of the type of material used for manufacturing the associated hand 18, 20, 22. Preferably, the number of strips $L_n$ is smaller in the thick bottom layer 41 than in the thin top layer 39.

Figure 8:
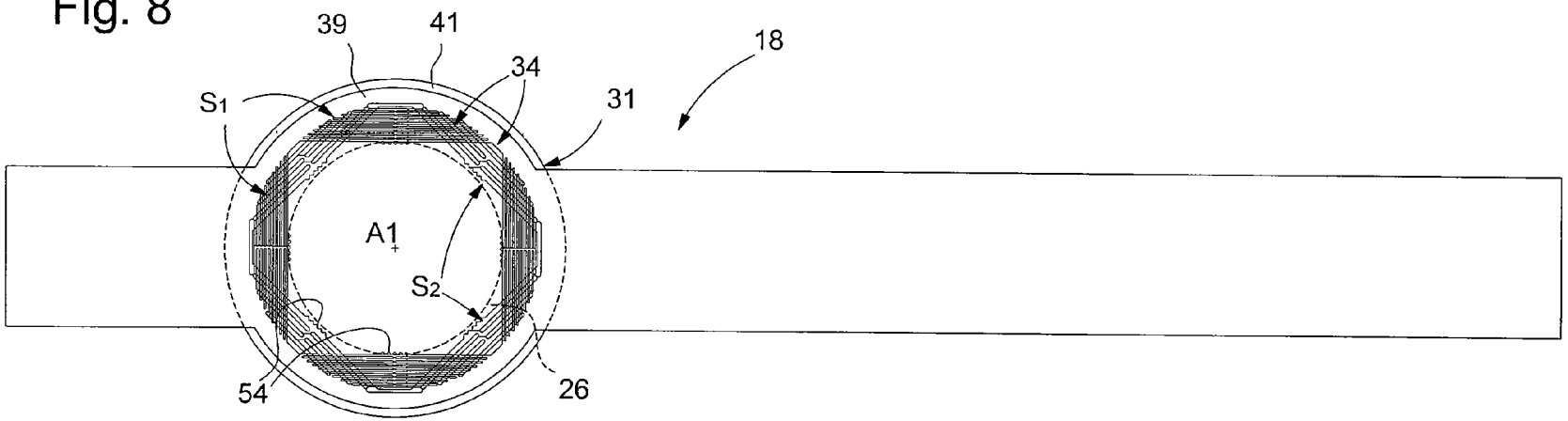
FIG. 8 is a similar view to that of FIG. 2 that shows an alternative embodiment of the elastic structures of the hour hand including raised elements of the support surfaces.

FIG. 8 shows an alternative embodiment of hour hand 18, which differs from the preceding embodiment in that each support surface 36, is provided with discrete raised elements 54, which increase the friction between arbor 26 and support surface 36, so as to improve the securing in rotation between arbor 26 and hand 18. Teeth of triangular profile etched in the first strip $L_1$ form these discrete raised elements 54 here.

Of course, this variant is applicable to support surfaces 36, 46 arranged in apertures 32 of minute hand 20 and second hand 22 described with reference to FIGS. 3 and 4.

Figure 9:
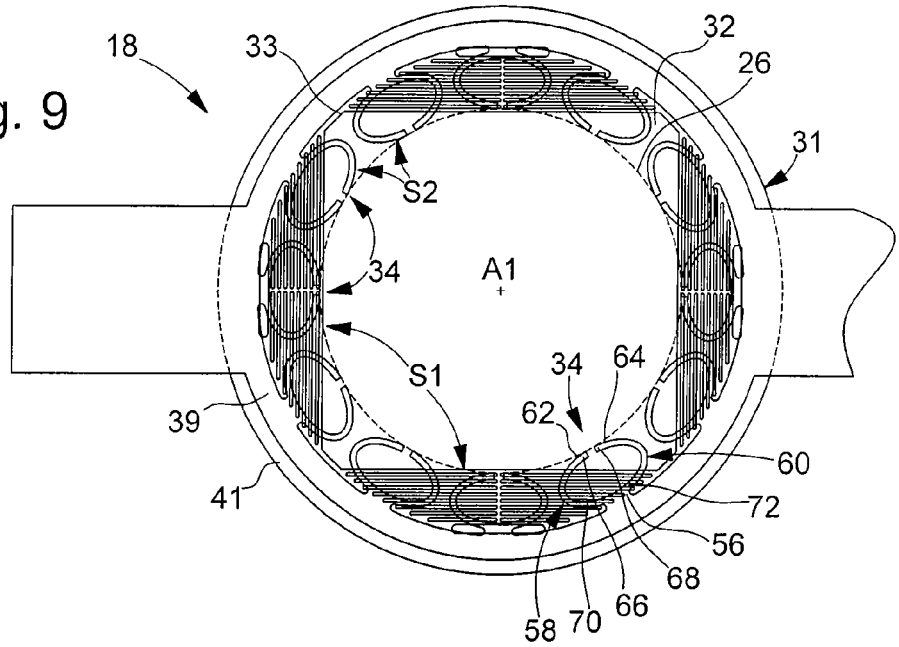
FIGS. 9 to 11 are similar views to that of FIG. 5 which show a second embodiment respectively of the hour hand, the minute hand and the second hand, wherein the bottom layer and the top layer include elastic structures of different types.
Figure 10:
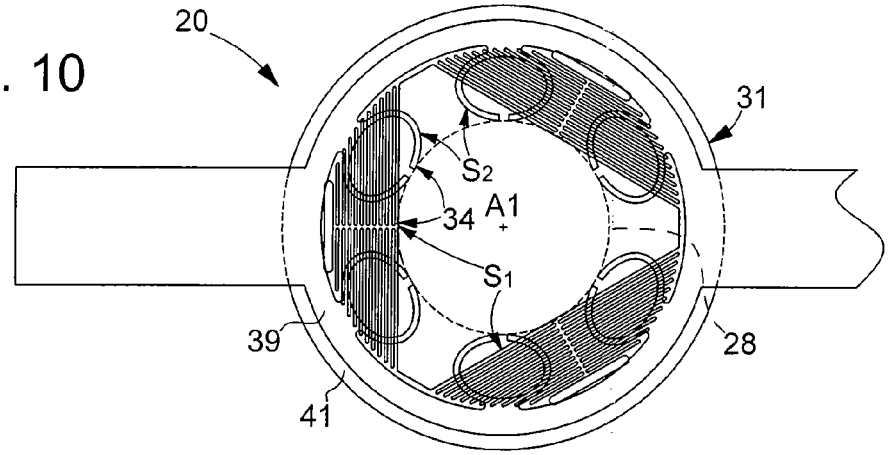
Figure 11:
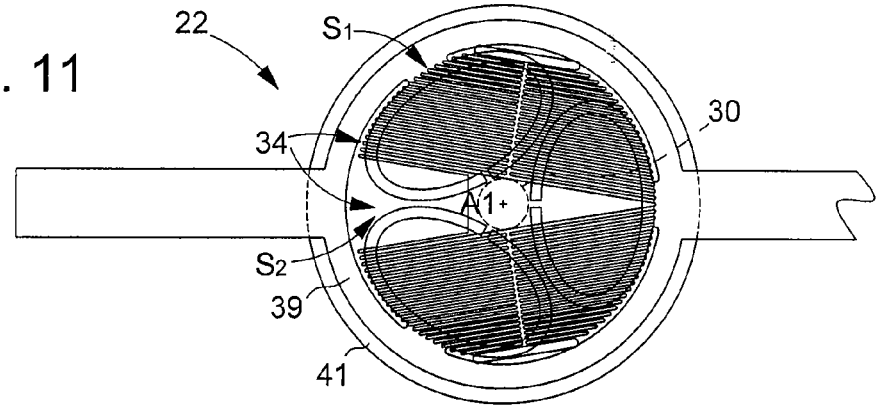

According to a second embodiment, which is shown in FIGS. 9 to 11, the two series S1, S2 of elastic structures 34 arranged on each hand 18, 20, 22 are of different types. More specifically, the first series S1 of elastic structures 34 is of the type with stacked elastic strips $L_n$, as described and shown with reference to the first embodiment, and the second series S2 of elastic structures is of the type with fork shaped elastic structures 34.

Each elastic structure 34 of the second series S2 is formed by a fork, which is connected to the inner wall 33 of aperture 32 by a bridge of material 56 and which includes two branches 58, 60, extending, on either side of the bridge of material 56, generally towards arbor 26, 28, 30. Moreover, each branch 58, 60 includes a support surface 62, 64 in proximity to the free end 66, 68 thereof.

According to the second embodiment, the two branches 58, 60 of each elastic structure 34 are bent towards each other forming an almost closed "C".

This second embodiment is described considering the hour hand 18 as shown in FIG. 9. It will be noted that the elastic structure, 34 are here represented at rest i.e. before being deformed by the insertion of the associated arbor 26, 28, 30.

Each branch 58, 60 of each elastic structure 34 has the shape of a substantially parabolic curve, a first fixed end 70, 72 of which is arranged on the associated bridge of material 56 and a second free end 66, 468 of which faces the free end 66, 68 of the other branch 58, 60 of elastic structure 34.

Preferably the free ends 66, 68 of branches 58, 60 of each elastic structure 34 are sufficiently close that the inner face of each branch 58, 60 is substantially tangent to the axial surface of arbor 26, in proximity to the free ends 46, 68, the support surface 62 64 of each branch 58, 60 thus being located on the inner face of the free end section thereof, opposite arbor 26.

When arbor 26 is inserted into aperture 32, the radial effort exerted on support surfaces 62, 64 causes an elastic deformation of the two branches 58, 60 of elastic structure 34, such that the free ends 66, 68 of branches 58, 60 move radially outwards. This elastic deformation generates radial gripping on arbor 26 similar to a driving in arrangement.

Preferably, elastic structures 34 are distributed regularly around axis A1.

Figure 12:
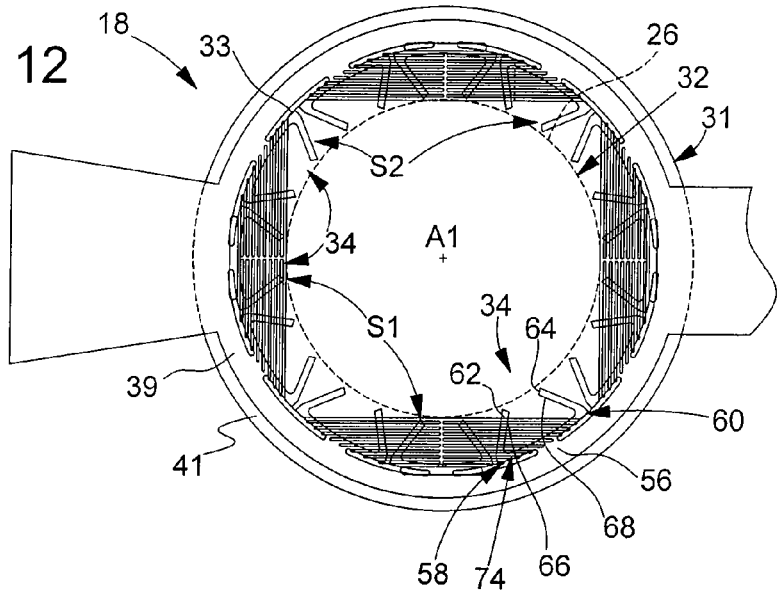
FIGS. 12 to 14 are similar views to those of FIGS. 9 to 11 that show a third embodiment respectively of the hour hand, the minute hand and the second hand wherein the bottom layer and the top layer include elastic structures of different types.
Figure 13:
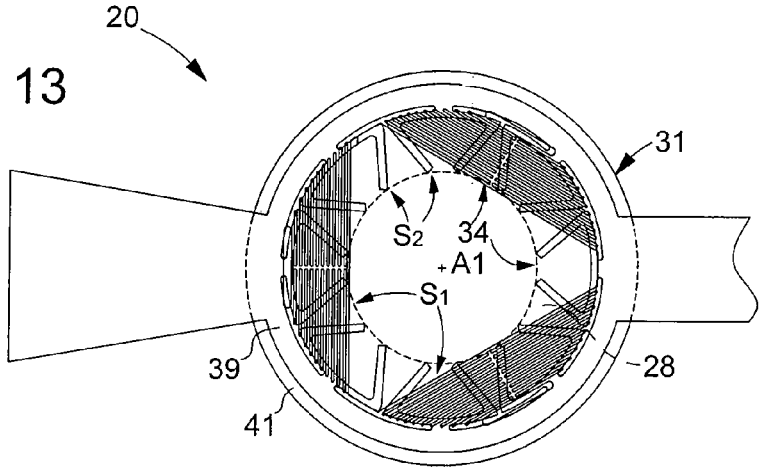
Figure 14:
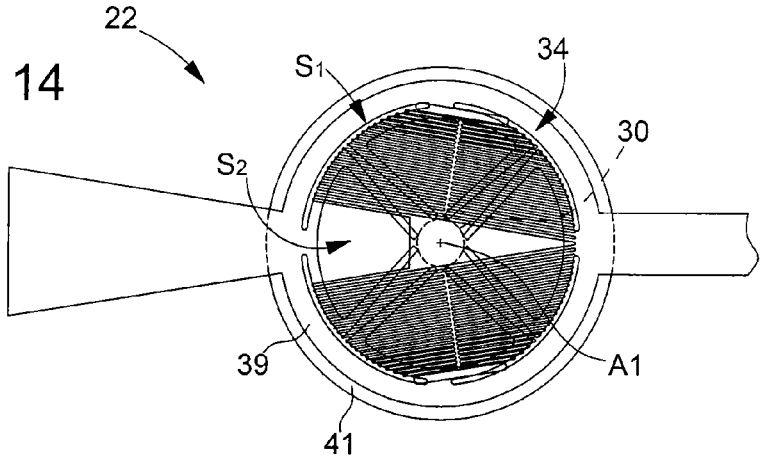

A third embodiment of the invention is shown in FIGS. 12 to 14. This third embodiment is similar to the second embodiment in that the elastic structures 34 of the first series S1 are formed of stacked elastic strips $L_n$ and in that the elastic structures 34 of the second series S2 are formed of forks with two branches 58, 60. The third embodiment differs from the second mainly in that each elastic structure 34 includes a main section 74 that extends on either side of bridge of material 56. Each branch 58, 60 extends, from the end of the main section 74 opposite to bridge of material 56, along a rectilinear direction. Each branch 58, 60 is inclined towards the associated branch 58, 60, relative to a radial direction. The support surface 62, 64 of each branch 58, 60 is arranged at the free end 66, 68 of branch 58, 60.

Preferably, the main section 74 of each elastic structure 34 extends along a substantially circumferential direction, parallel to the inner cylindrical wall 33 of aperture 32, which maximizes the length of main section 74 and rectilinear branches 58, 60 in order to distribute the stresses linked to the elastic deformation of branches 58, 60 in a larger volume.

The third embodiment has the advantage of producing a self-locking effect, when arbor 26, 28, 30 and the associated hand 18, 20, 22 are assembled to each other. Indeed, the inclination of branches 58, 60 allows a dynamic reaction to an acceleration in rotation which makes this embodiment particularly suited to securing assembly elements subject to high angular accelerations or in the event that the rotating element has a significant unbalance in the distribution of weights, which is the case for the hands of a timepiece.

In the third embodiment, the two branches 58, 60 of each elastic structure 34 exert thrust efforts in opposite directions, such that each branch 58, 60 opposes the relative rotation of hand 18, 20, 22 relative to the associated arbor 26, 28, 30 in a preferred direction of rotation. In the example shown in FIG. 12, the first branch 58 of each elastic structure 34 opposes the relative rotation of hand 18 in the anticlockwise direction and the second branch 60 of each elastic structure 34 opposes the relative rotation of hand 18 in the clockwise direction. The elastic structures 34 of the third embodiment thus provide a particularly efficient securing arrangement in rotation between the hands 18, 20, 22 and the associated arbors 26, 28, 30.

Making elastic structures 34 in the form of forks including one section oriented tangentially or circumferentially (section 56) and a rectilinear section (branch 58, 60) oriented towards the associated arbor 26, 28, 30 reduces the stiffness of elastic structure 34 which allows a radial clearance of sufficient value to allow said structure to be secured to arbor 26, 28, 30, in particular to compensate for the arbor diameter tolerances. Each elastic structure 34 must have sufficient flexibility to be secured both to an arbor having a smaller diameter than the nominal value and to an arbor having a larger diameter than the nominal value.

The advantages mentioned here with reference to the third embodiment apply in part to the first embodiment, since making the elastic structures including two branches 58, 60 offers the advantage of a dynamic reaction to an angular acceleration. Moreover, the curved branches 58,60 of the second embodiment also allow a decrease in the stiffness of elastic structure 34 to be obtained and an adequate radial clearance for securing to the arbor.

It will be noted that, in the first and second embodiments, each elastic structure 34 has an axial plane of symmetry P which extends along a radius passing through the middle of bridge of material 40.

The combinations of elastic structures of different types used in the second and third embodiments are particularly advantageous when the elastic structures 34 with stacks of elastic strips Ln are arranged in the thin top layer 39 and the fork shaped elastic structures 34 are arranged in the thick bottom layer 41. Indeed, for reasons of manufacturing and etching process, obtaining the smallest apertures possible in a silicon layer depends upon the thickness of the layer. The elastic gripping force of each elastic structure 34 is proportional to the cube of the axial thickness of the elastic structure 34, which means that a layer including a relatively reduced number of elastic strips, as is the case with fork shaped structures will have difficulty in developing sufficient gripping force. Consequently, the elastic structures 34 most suited to the thin top layer 39 are the structures with stacks of elastic strips Ln since they implement a large number of elastic strips. Moreover, the arrangement of this type of elastic structure 34 with stacked elastic strips in this top layer 39 minimizes the radial spaces between the elastic strips Ln and thus increases the number of elastic strips Ln compensating for the lower elastic return force due to the small axial thickness of these elastic strips Ln.

Of course, the embodiments described above could be combined with each other or with other embodiments. In particular, the elastic structures 34 could be of different types, for example made in accordance with the teaching of EP Patent No 1 655 642. The type of elastic structures 34 chosen for each layer 39, 41 could also be reversed, in relation to the embodiments described, in particular the elastic structures 34 of the type with stacked elastic strips $L_n$ could be arranged in the bottom layer 41 and the fork shaped elastic structures 34 could be arranged in the top layer 39.

According to a variant (not shown), hands 18, 20, 22 could be made in a symmetrical SOI type plate, i.e. a plate wherein the top and bottom layers 39, 41 have the same thickness.

Although the present invention has been described with respect to assembly elements formed by hands 18, 20, 22, it is not limited to these embodiments. Thus, the assembly element could be formed by another type of rotating element, for example by a toothed wheel used in a timepiece movement. The assembly element could also be formed by a non-rotating element, for example a plate of brittle material provided for assembly on another element including a securing arbor, or stud, made of metal.

What is claimed is:

1. An assembly element made in a plate of brittle material such as a silicon, particularly for a timepiece, including an aperture provided for the axial insertion of an arbour, the inner wall of the aperture including elastic structures which are etched into the plate and which each include at least one support surface that grips the arbour radially and fixedly secures the assembly element in rotation relative to the arbour, wherein the assembly element includes a first series of elastic structures etched in a top layer of the plate and a second series etched in the bottom layer of the plate.

2. The assembly element according to claim 1, wherein the elastic structures of the two series are of the same type.

3. The assembly element according to claim 1, wherein the elastic structures of the first series are of different types to the elastic structures of the second series.

4. The assembly element according to claim 1, wherein the two series of elastic structures are shifted angularly in relation to each other, such that at least one part of the support surfaces thereof are angularly shifted in relation to each other.

5. The assembly element according to claim 1, wherein the plate is of the asymmetrical silicon on insulator type with a top layer and a bottom layer of silicon separated by an intermediate layer of silicon oxide.

6. The assembly element according to claim 5, wherein plate is of the asymmetrical silicon on insulator type with a thin top layer and a thick bottom layer, and wherein the first series of elastic structures is made in the top layer and the second series of elastic structures is made in the bottom layer.

7. The assembly element according to claim 6, wherein it is formed by a rotating element that is fixedly mounted in rotation to the arbour, wherein the main body of the rotating element extends into the top layer, wherein the second series of elastic structures is made in an axial extension of the main body located in the bottom layer.

8. The assembly element according to claim 1, wherein it is formed by a timepiece hand.

9. The assembly element according to claim 1, wherein at least one series of elastic structures is of the type wherein each elastic structure is formed by a radial stack of several parallel elastic strips, each elastic strip being separated radially from the adjacent elastic strip by a rectilinear separator hole in two parts 1na, 1nb, the two parts of the separator hole being separated by a bridge of material which connects the two adjacent elastic strips and which is substantially aligned radially with the support surface, and wherein the last elastic strip of the stack, which is located on the opposite side to the first strip is separated radially from the rest of the plate by a hole in a single part, called the clearance hole, which defines a radial clearance space for the elastic structure.

10. The assembly element according to claim 1, wherein at least one series of elastic structures is of the type wherein each elastic structure is formed by a fork which is connected to the inner wall of the aperture by a bridge of material and which includes two branches extending, on either side of the bridge of material, generally towards the arbour, each branch including a support surface in proximity to the free end thereof.

11. The timepiece wherein it includes an assembly element according to claim 1.

12. An assembly element made in a plate of brittle material, particularly for a timepiece, including:

an aperture provided for the axial insertion of an arbour, an inner wall of the aperture including elastic structures which are etched into the plate and which each include at least one support surface for gripping the arbour radially in order to secure the assembly element relative to the arbour;

wherein the assembly element includes a first series of elastic structures etched in a top layer of the plate and a second series etched in the bottom layer of the plate; and wherein the plate is an asymmetrical silicon on insulator type, with a top layer and a bottom layer of silicon separated by an intermediate layer of silicon oxide.

13. The assembly element according to claim 12, wherein the plate is of the asymmetrical silicon on insulator type with a thin top layer and a thick bottom layer, and wherein the first series of elastic structures is made in the top layer and the second series of elastic structures is made in the bottom layer.

14. The assembly element according to claim 13 in the form of a rotating element that is fixedly mounted in rotation to the arbour, wherein the main body of the rotating element extends into the top layer, and wherein the second series of elastic structures is made in an axial extension of the main body located in the bottom layer.

* * * * *